US007658138B2

(12) United States Patent
Wössner et al.

(10) Patent No.: US 7,658,138 B2
(45) Date of Patent: Feb. 9, 2010

(54) PRACTICE BARRELS FOR USE WITH PRACTICE CARTRIDGES

(75) Inventors: Ernst Wössner, Sulz (DE); Rudi Beckmann, Aichhalden (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 12/256,252

(22) Filed: Oct. 22, 2008

(65) Prior Publication Data

US 2009/0133310 A1 May 28, 2009

Related U.S. Application Data

(63) Continuation of application No. PCT/EP2007/003657, filed on Apr. 25, 2007.

(30) Foreign Application Priority Data

Apr. 27, 2006 (DE) ..... 10 2006 019 645

(51) Int. Cl.
*F41A 21/00* (2006.01)

(52) U.S. Cl. ..... 89/29; 89/14.05; 42/77; 42/76.01

(58) Field of Classification Search ..... 89/29, 89/14.05; 42/77, 76.01
See application file for complete search history.

(56) References Cited

U.S. PATENT DOCUMENTS 4,104,953 A * 8/1978 Bard et al. ..... 89/14.5
4,128,040 A 12/1978 Schuetz
5,729,927 A * 3/1998 Shaver, Jr. ..... 42/77
5,829,180 A * 11/1998 Leiter ..... 42/77
7,062,875 B1 * 6/2006 Stevens et al. ..... 42/77
7,380,363 B1 * 6/2008 Kirschner ..... 42/76.01

FOREIGN PATENT DOCUMENTS

DE 867367 2/1953
DE 102004047628 4/2006

OTHER PUBLICATIONS

Patent Cooperation Treaty, "International Search Report," issued by the International Searching Authority in connection with international counterpart PCT application No. PCT/EP2007/003657, mailed Aug. 14, 2007, 4 pages.
Patent Cooperation Treaty, "Written Opinion of the International Searching Authority," issued by the International Searching Authority in connection with international counterpart PCT application No. PCT/EP2007/003657, mailed Aug. 14, 2007, 8 pages.
Patent Cooperation Treaty, "International Preliminary Report on Patentability," issued by the International Bureau on Dec. 24, 2008, in connection with a counterpart international application No. PCT/EP2007/003657 (6 pages).

* cited by examiner

*Primary Examiner*—J. Woodrow Eldred
(74) *Attorney, Agent, or Firm*—Hanley, Flight and Zimmerman, LLC

(57) ABSTRACT

Practice barrels for use with practice cartridges are described herein. An example practice device for use with self-loading grenade launchers includes a practice barrel having a practice cartridge chamber to receive a practice cartridge. A live cartridge does not correspond to the practice cartridge chamber. Additionally, the live cartridge is unable to be properly positioned within the practice barrel to prevent ignition of the live cartridge. Further, the practice cartridge chamber is cushioned to substantially absorb a breech energy to substantially prevent damage to the practice barrel.

18 Claims, 2 Drawing Sheets

PRACTICE BARRELS FOR USE WITH PRACTICE CARTRIDGES

RELATED APPLICATION

This patent is a continuation of International Patent Application Serial No.—PCT/EP2007/003657, filed Apr. 25, 2007, which claims priority to German Patent Application 10 2006 019 645.7, filed on Apr. 27, 2006, both of which are hereby incorporated herein by reference in their entireties.

FIELD OF THE DISCLOSURE

This patent relates generally to weapons and, more specifically to practice barrels for use with practice cartridges.

BACKGROUND

For training purposes, military recruits are commonly provided with a firearm along with dummy cartridges to acquaint the recruits with the firearm and handling ammunition. In some examples, the dummy cartridges are solid or hollow projectile-shaped objects that have dimensions that are substantially similar to live ammunition. However, the dummy cartridges are not ignitable or dischargeable through a firearm. The dummy cartridges enable recruits to learn safe weapons handling by repeating the exercises learned during training in their living quarters. In time, these recruits receive further training in the use of other infantry weapons (e.g., pistols, submachine guns, machine guns, flare guns, etc.) in which dummy cartridges are not used. Specifically, recruits perform training exercises without cartridges in practice rooms and, later, the recruits perform training exercises with blank cartridges in training areas such as, for example, the U.S. Army Garrison Training Area.

In recent years, self-loading grenade launchers have been adopted by many armies and have proven useful in further equipping armored personnel carriers and helicopters. Additionally, self-loading grenade launchers can be advantageously utilized by infantries for engaging medium range targets and to enable soldiers to move freely within the area of interaction. Self-loading grenade launchers fire explosive ammunition that has similar effects to a hand grenade, but, in contrast, explosive ammunition from the self-loading grenade launcher has an effective distance of approximately 1500 meters.

A known self-loading grenade launcher, a patent for which is assigned to the assignee of the present patent, includes a blow-back mechanism and utilizes belted ammunition. Specifically, a belt link remains on the cartridge or its casing during firing and both the belt link and the casing are ejected from the firearm together. Additionally, during firing, because the muzzle energy of such firearms is relatively high and the breech block is actuated relatively effortlessly, the cartridge is ignited once the cartridge is introduced into the cartridge chamber while the breech block is in a counter-recoil. After the cartridge is ignited, energy toward the rear of the firearm from the ignition substantially stops the movement of the breech block before the breech block engages a stop on the barrel or firearm. After the breech block stops, the breech block begins to recoil.

Firearms, such as self-loading grenade launchers are typically not utilized during basic training because such firearms have a relatively narrow target range, which requires a longer training period to become proficient. Additionally, self-loading grenade launchers and training exercises on vehicles and/or helicopters are relatively expensive. Further, the area in which exercises may be performed with vehicles and blank ammunition is somewhat limited because of the noise generated from the vehicles and from firing the blank ammunition and the size area required to perform such exercises. As a result, training exercises within the classroom are maximized by utilizing dummy ammunition that enables the recruits to practice loading the firearm, pulling the firearm's trigger and unjamming the firearm. However, dummy ammunition utilized with standard barrels has a relatively short useful life. Specifically, when using a dummy cartridge, the momentum of the breach block of the firearm is not reduced because the dummy cartridge does not ignite and does not produce energy from ignition toward the rear of the firearm to oppose the counter-recoil of the breech block and, thus, the breech impacts the practice cartridge and/or the barrel. Over time, these impacts damage the practice cartridges.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The example apparatus described herein relate to practice barrels for use with practice cartridges. In particular, the practice barrels are interchangeable with live round-handling barrels and may be advantageously utilized in practice exercises. The size and/or shape of the practice barrel corresponds to the size and/or shape of the practice cartridges and not the size and/or shape of the live cartridges. This sizing ensures that the live cartridges are unable to be fired through the practice barrel.

Additionally, to advantageously extend the useful life of the practice barrel and/or the practice cartridges, the example practice barrels described herein are provided with, for example, a spring assembly to cushion the impact of a breech block of the grenade launcher during dry firing to substantially prevent the damage to the practice barrel and/or the practice cartridge that is associated with known live round-handling barrels.

Prior to deployment, recruits typically have training with self-loading grenade launchers to become proficient. However, currently, it is uncommon for practice cartridges to be utilized with grenade launchers because these grenade launchers are often also used at practice ranges with practice ammunition (e.g., blank ammunition) and/or live ammunition both of which may cause extensive damage and, thus, the possibility that such ammunition may be mistakenly combined with the practice cartridges is too dangerous for the grenade launchers to be utilized in practice rooms. Specifically, when using rapid-firing weapons, it is too difficult to precisely monitor the number of rounds fired through the weapon and there is always the possibility that a recruit, unintentionally, takes one of the live cartridges and/or blank cartridges back to the barracks and mixes these cartridges with the practice cartridges in a training session in an attempt to get rid of the cartridge.

Figure 1:
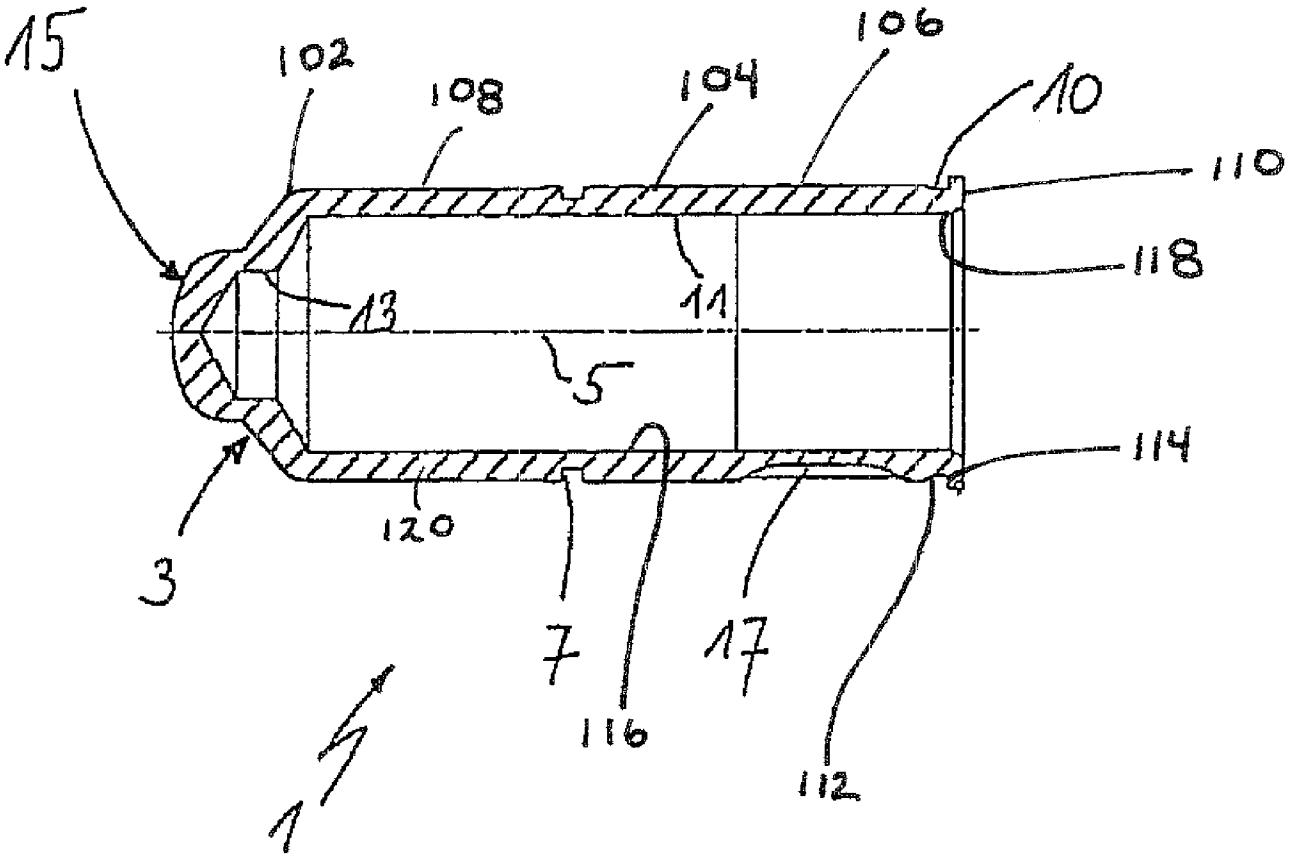
FIG. 1 depicts an example practice cartridge.

FIG. 1 depicts an example practice cartridge 1 that is configured to have approximately the same length as a live cartridge (not shown). In contrast to live cartridges, the practice cartridge 1 includes a tapered surface or annular gradation 3 adjacent an end or tip 15. The practice cartridge 1, including the annular gradation 3, is rotationally symmetrical relative to an axis 5. However, other portions of the practice cartridge 1 have a diameter that is associated with a particular caliber.

In some examples, a distance between a position 102 on the practice cartridge 1 and the tip 15 is approximately 20 millimeter (mm). Additionally, a groove 7 (e.g., a snap-ring groove) is positioned about the center of the practice cartridge 1 on an exterior surface 104. The position of the groove 7 corresponds to an interface between a shell casing (not shown) and a projectile (not shown) of the live cartridge. The practice cartridge 1 has a first diameter on a first side 106 of the groove 7 that is, in some examples, approximately one half millimeter greater than a second diameter on a second side 108 of the groove 7. Additionally, adjacent an outer edge 110, the practice cartridge 1 includes a groove 10 (e.g., a serrated snap-ring groove) that has a tapered surface 112 toward a front of the practice cartridge 1 and an edge 114 toward a rear of the practice cartridge 1. The groove 10 is substantially similar to a groove (not shown) of the live cartridge.

Further, the practice cartridge 1 includes a recessed portion, groove or slot 17 (e.g., a milled slot) along the first side 106 toward the axis 5 on the exterior surface 104 on the first side 106 of the practice cartridge 1. In practice, the slot 17 is positioned adjacent a portion (not shown) of a belt link (not shown) to substantially prevent damage (e.g., scratching) of the practice cartridge 1 when the practice cartage 1 is utilized during, for example, training exercises. Specifically, the belt link is shifted toward the rear of a barrel (not shown) each time the practice cartridge 1 is introduced into a firearm (not shown) and the belt link is then moved by the marksman toward the front of the barrel prior to introducing another practice cartridge 1. Additionally, the slot 17 advantageously differentiates the practice cartridge 1 from the live cartridge.

An interior 116 of the practice cartridge 1 includes a first bore 11 (e.g., a bore hole) that has an opening 118 to the rear of the practice cartridge 1 that is adjacent the outer edge 110 and a second bore 13 (e.g., a tip bore hole) that is adjacent the first bore 11. In some examples, the first bore 11 has a relatively larger diameter than the second bore 13 and the first and second bores 11 and 13 are concentric with the axis 5. The diameter of both the first and second bores 11 and 13 are such that a weight (e.g., a characteristic) of the practice cartridge 1 corresponds to a weight (e.g., a characteristic) of the live cartridge.

In some examples, the practice cartridge 1 is made from stainless steel or low rust steel that is left blank to enable a marksman to readily distinguish the practice cartridge 1 from, for example, the live cartridge having a gray-green case and a black grenade and/or a blank cartridge having a gray-green case and a blue projectile. A manganese chrome steel (about 16 Mn Cr 5) is preferably utilized to manufacture and/or fabricate the practice cartridge 1 because of its relative hardness and resistance toward rusting. However, in other examples, the practice cartridge 1 may be made of any other suitable material provided with a readily identifiable characteristic.

Figure 2:
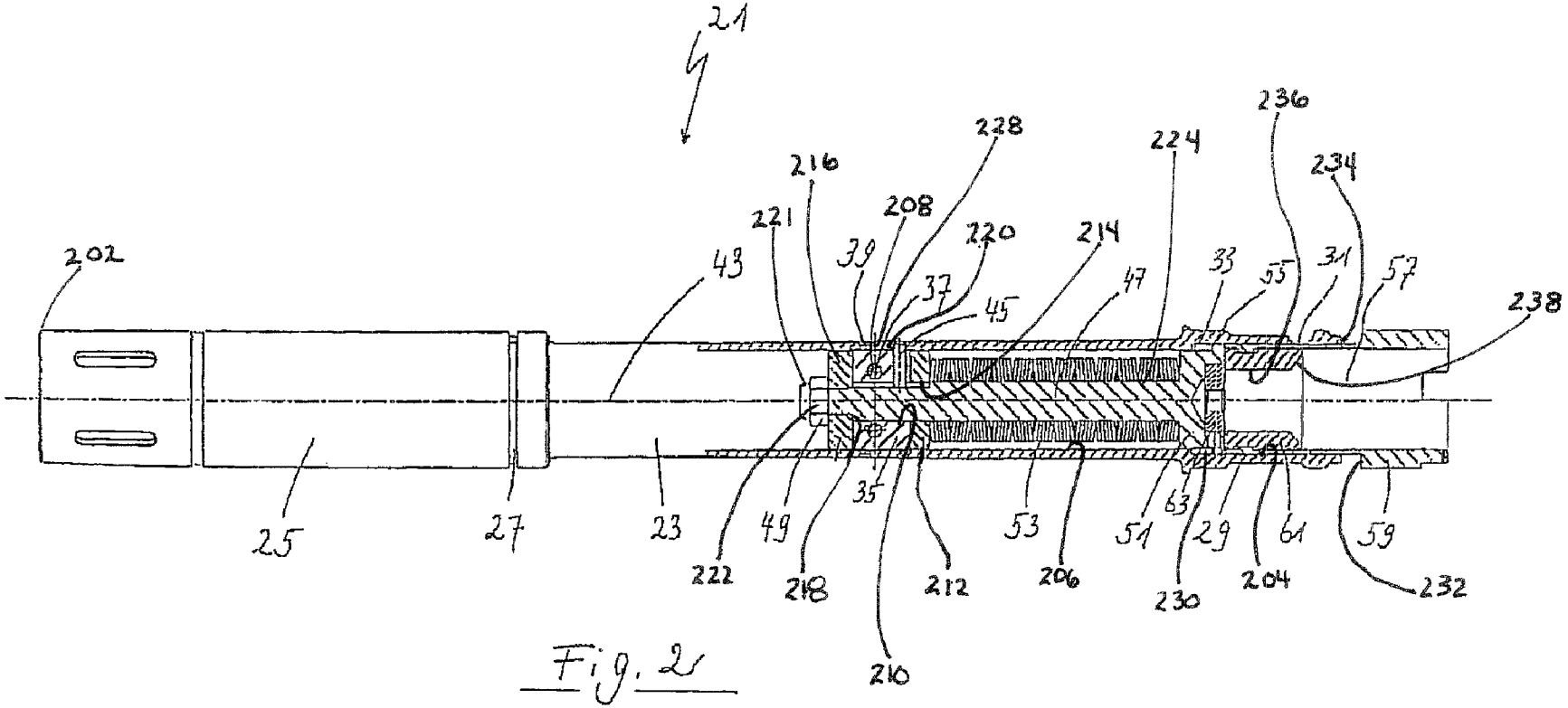
FIG. 2 depicts an example practice barrel.

FIG. 2 depicts an example practice barrel 21 that is used in conjunction with the practice cartridge 1 as a practice device. The practice barrel 21 includes a first portion 23 (e.g., a stationary portion) that is coupled to a grenade launcher (not shown). The practice barrel 21 has dimensions that are substantially similar to a live round-handling barrel (not shown). However, the practice barrel 21 has readily identifiable characteristics that differentiate the practice barrel 21 from the live round-handling barrel. Specifically, the practice barrel 21 may be provided with chrome plating on a second portion 25 (e.g., a front part) between, for example, an end 202 and a groove 27. However, in other examples, the practice barrel 21 may be provided with any other readily identifiable characteristic.

To couple the practice barrel 21 to the grenade launcher, an anchoring section 29 of the first portion 23 is positioned within a bearing block housing (not shown) of the grenade launcher. Specifically, a locking bar (not shown) of the grenade launcher engages a groove 31 (e.g., a locking groove) of the anchoring section 29 to couple the practice barrel 21 to the grenade launcher.

A diameter of a first bore 204 of the anchoring section 29 is relatively larger than a diameter of a second bore 206 of the first portion 23. The practice barrel 21 is provided with a step, lip and/or edge 33 that may be advantageously utilized as a stop (e.g., an emergency stop), which is described in more detail below.

A block 35 is positioned within the second bore 206 of the first portion 23 that is coupled within the first portion 23 via a plurality of fasteners or cross-pins 37 that are positioned in a plurality of through holes 208 through the block 35 and the practice barrel 21 to provide an interference fit. Additionally, a weld 39 or any other suitable fastening means is advantageously utilized to ensure that the block 35 remains positioned within the first portion 23 even if the cross-pins 37 fail as a result of extended use. The block 35 includes an aperture 210 that is substantially coaxial with an axis 43 of the second bore 206. A first washer or spacer 212 having a first aperture 214 is positioned on a first side of the block 35 and a second washer or spacer 216 having a second aperture 218 is positioned on a second side of the block 35. The first and second apertures 214 and 218 are coaxial with the axis 43. However, the second aperture 218 is relatively smaller than the first aperture 214 and the first aperture 214 and the aperture 210 of the block 35 have substantially the same diameter.

The first portion 23 includes an aperture 220 through which a radial stop pin 45 is inserted and received by the block 35. A shaft 47 is positioned within the practice barrel 21 and partially positioned within the aperture 210 and the first and second apertures 214 and 218. The shaft 47 is substantially coaxial with the axis 43 and includes a threaded end 221 that is threadingly engaged by a fastener or nut 49 positioned adjacent the second washer 216. The shaft 47 is coupled to a piston 51 that is at least partially positioned within the second bore 206. In some examples, there is a distance between about 100 mm between the first washer 212 and the piston 51 in which a spring assembly 53 (e.g., a disc spring assembly) is positioned. The spring assembly 53 at least partially surrounds the shaft 47 between the first washer 212 and the piston 51. Although, in this example, the spring assembly 53 includes a plurality of disc springs, in other examples, any other type of biasing means may be utilized. In practice, the shaft 47 and the piston 51 are movable against a force exerted by springs of the spring assembly 53.

In this example, a first shaft portion 222 of the shaft 47 has a diameter that corresponds to the second aperture 218 and a second shaft portion 224 has a diameter that corresponds to the aperture 210 and the first aperture 214, which is relatively larger than the diameter of the first shaft portion 222. The second washer 216 is coupled to the shaft 47 between a step 226 of the shaft 47 and the nut 49 that is removably coupled to the first shaft portion 222. In practice, the second washer 216 may be moved toward the front of the practice barrel 21 when the spring assembly 53 is deflected. Additionally, the second washer 216 limits the movement of the piston 51 toward the rear of the practice barrel 21 to the length of the shaft 47 by engaging the block 35 that is coupled within the second bore 206 via the cross-pins 37 and the weld 39.

The stop pin 45 is positioned in the aperture 220 and received by the block 35. The stop pin 45 engages a surface 228 of the aperture 220 to limit the travel of the shaft 47 and the piston 51 toward the front of the practice barrel 21 if, for example, the weld 39 breaks. Additionally, the stop pin 45 advantageously enables the nut 49 to be loosened from the threaded end 221 of the shaft 47 without the piston 51 or a third portion 59 (e.g., a connecting piece or elongated member) rotating or twisting within the second bore 206.

The piston 51 includes a flange 55 that is to engage the step 33 to substantially prevent further forward movement of the piston 51 when the piston 51 is moved within a recess 230 toward the front of the practice barrel 21. Additionally, the piston 51 includes the third portion 59 that extends toward the rear of the practice barrel 21. A first step 232 of the third portion 59 engages a second step 234 of the first portion 23 when the piston 51, the shaft 47, the nut 49 and the third portion 59 move toward the front of the practice barrel 21.

The third portion 59 includes a practice cartridge chamber 57 having a diameter that corresponds to the practice cartridge 1 (FIG. 1). However, a length of the practice cartridge chamber 57 prevents the live cartridge from being introduced into the practice cartridge chamber 57. Specifically, an insert 61 (e.g., a buffer body) having a bore 236 is positioned adjacent the practice cartridge chamber 57. The bore 236 corresponds to the tip 15 (FIG. 1) and/or the second side 108 (FIG. 1) of the practice cartridge 1 (FIG. 1) and not a tip of the live cartridge (not shown). Thus, the chamber that is formed, including the insert 61, is too small to accommodate a length of a live round. The insert 61 is positioned adjacent the piston 51 and is provided with a ring 63 that enables the insert 61 to be disassembled and/or removed from the practice barrel 21. Additionally, the third portion 59 includes the practice cartridge chamber 57 that has a diameter that corresponds to the diameter of the live cartridge. However, the practice cartridge chamber 57 is shorter than the live cartridge because the insert 61 is positioned toward the front of the practice cartridge chamber 57. The insert 61 has the bore 236 that only allows the tip 15 of the practice cartridge 1 to penetrate the bore 236 and not the tip of the live cartridge or the tip of the blank cartridge.

In practice, when the practice cartridge 1 (FIG. 1) is introduced to the practice cartridge chamber 57 from a breech block (not block) of the grenade launcher, the annular gradation 3 (FIG. 1) engages a tapered surface 238 of the insert 61 adjacent the piston 51. As the breech block engages the practice cartridge 1 and/or the insert 61, a force is exerted on the third portion 59, the practice cartridge 1, and/or the insert 61 that is transferred to the piston 51, the shaft 47, and the third portion 59. As such, the piston 51 moves forward against a rearward spring force exerted by the spring assembly 53. Typically, the piston 51 does not move forward a sufficient distance for the stop pin 45 to engage the surface 228 of the aperture 220, the step 33 to engage the flange 55, or the first step 232 of the third portion 59 to engage the second step 234 of the first portion 23. As a result, the breech block of the grenade launcher is substantially cushioned via the interaction of the practice cartridge 1 with the insert 61, the piston 51, and the spring assembly 53.

If however, a live cartridge, a different practice cartridge, or a blank cartridge is accidently loaded into the practice barrel 21, the grenade, the projectile or the dummy grenade will be positioned adjacent the insert 61. However, the bore 236 of the insert 61 is sized to ensure that the grenade, the projectile or the dummy grenade is unable to be properly positioned within the bore 236. Additionally, to ensure that the live cartridge is unable to be loaded into the practice barrel 21, the shape and/or size of the live cartridge does not fit within a connecting link of the practice barrel 21 that includes the third portion 59. Specifically, if the live cartridge is loaded into the practice barrel 21, the piston 51 may move forward slightly, however, the distance that the piston 51 may move forward is insufficient to activate a cartridge ejection mechanism (not shown) of the grenade launcher and, thus, the live cartridge is unable to be ignited within the practice barrel 21.

In some examples, the insert 61 may be interchanged with other inserts to enable a different shaped practice cartridge (e.g., a practice cartridge similar to the practice cartridge 1 of FIG. 1) to be utilized or to replace a damaged insert 61. The ring 63 may be made of a hard, pliant, and/or flexible material. In practice, the insert 61 may be removed from the third portion 59 via the ring 63 and a connecting rod (not shown).

The tapered surface 238 of the insert 61 may be longer than the annular gradation 3 (FIG. 1) of the practice cartridge 1 (FIG. 1) to, for example, substantially prevent the practice cartridge 1 (FIG. 1) from engaging the ring 63 and/or to create a buffer zone.

In some examples, an alternative plastic blank cartridge (not shown) may be utilized with the practice barrel 21. In such examples, the size and/or shape of the plastic blank cartridge corresponds to the size and/or shape of the practice cartridge 1 (FIG. 1). Additionally, if the plastic blank cartridge is utilized with the practice barrel 21 the insert 61 and the ring 64 are made of a material that is resistant to temperature and to the chemical composition of the launching gases associated with the plastic blank cartridge. Further, if the plastic blank cartridge is utilized with the practice barrel 21, the shaft 47 may be hollow or include a bore therethrough to enable the launching gases to exit the practice barrel 21 toward the front of the shaft 47.

In contrast to the practice cartridge 1 of FIG. 1, the plastic blank cartridge is ignited, which produces energy toward the rear of the firearm from the ignition that substantially stops the movement of the breech block before the breech block engages a stop on the barrel or firearm and thereafter the breech block begins to recoil. Specifically, a delay combustion unit is utilized that delays the burning of the ignition materials by a few milliseconds that substantially stops the movement of the breech block before the breech block engages a stop on the barrel or firearm and, thus, the breech block begins a reloading process.

The practice barrel 21 is interchangeable with the live round-handling barrel and, thus, an older, reject, and/or scraped live round-handling barrel may be retrofitted to become the practice barrel 21.

The first side 106 of the practice cartridge 1, which is to be positioned within the belt, has a diameter that is similar to the diameter of the live cartridge. However, the second side 108 of the practice cartridge 1 has a smaller diameter than the diameter of the live cartridge. Additionally, the second side 108 of the practice cartridge 1 is shorter than the projectile (not shown) of the live cartridge. Specifically, to ensure that the live cartridge is not inadvertently fired through the practice barrel 21, a distance between about 20 mm between the tip 15 toward the rear of the practice cartridge 1 has a diameter that is reduced by approximately half the caliber diameter. Additionally, if the live cartridge is introduced into the practice barrel 21, the live cartridge is unable to be properly positioned within the practice cartridge chamber 57. Specifically, the live cartridge is stopped at a distance from where an ignition can take place. This distance takes into account production tolerances of the practice barrel 21 and/or the grenade launcher and wear and tear on components over time. Testing has shown that a distance between about 90 mm from the ring 63 to the tapered surface 238 is a sufficient distance. However, the diameter of the bore 236 does not prevent the practice cartridge 1 (FIG. 1) from being introduced into the practice barrel 21, especially if the tip 15 has a reduced diameter and is well rounded.

Other portions of the practice cartridge 1 may be constructed, manufactured and/or fabricated similarly to the live cartridges. The practice cartridge 1 includes the slot 17 that is positioned along the axis 5 that corresponds to a projection (not shown) of the belt link and permits the belt link to shift toward the rear. As a result, the belt, which provides a relatively tight fit about the live cartridges, may not scratch the practice cartridges 1 and, thus, the practice cartridges 1 may be made of a less rigid or hard material and still be utilized multiple times.

To fabricate, manufacture and/or produce the practice cartridges 1, in some examples, the practice cartridges 1 may generally be made of a relatively hard solid material. However, a soft material may be utilized in the area in which a detonator cap (not shown) is positioned on the live cartridge to prevent a firing pin (not shown) of the grenade launcher from being damaged (e.g., flattened or broken off) from striking the relatively hard solid material. However, it would be relatively expensive to produce practice cartridges having the soft material and some grenade launchers have features that prevent the firing pin from impacting the cartridge during dry firing and, thus, the practice cartridge 1 may preferably include the first bore 11 and the opening 118. As a result, the firing pin does not impact the practice cartridge 1.

Additionally, the first bore 11, the second bore 13 and the opening 118 advantageously enables walls 120 of the practice cartridge 1 to have a thickness such that the practice cartridge 1 has approximately the same weight and/or balance (e.g., a characteristic) as the live cartridge. In some examples, the practice cartridge 1 is fabricated, manufactured and/or produced from a single piece of material that is turned and then bored and, thus, the practice cartridge 1 is readily distinguishable from the blank cartridge and the live cartridge. Specifically, if the practice cartridge 1 is accidently mixed with the blank cartridges and/or the live cartridges, the practice cartridge 1 can be identified and brought back to its proper storage location for reuse.

As discussed above, the practice barrel 21 is provided with the insert 61 that is inserted into the third portion 59 and removably coupled adjacent the practice cartridge chamber 57. The insert 61 may be made of a soft and/or flexible material. If the live cartridge is introduced to the practice cartridge chamber 57, the live cartridge abuts the tapered surface 238 of the insert 61 and is unable to be inserted into the bore 236. However, the bore 236 corresponds to the practice cartridge 1 so that the practice cartridge 1 moves unimpeded within the practice barrel 21. The insert 61 may be provided with a rivet (not shown) that is, for example, welded within the practice barrel 21 to engage a portion (not shown) of the live cartridge to prevent the live cartridge from being ignited and/or fully inserted within the practice barrel 21. However, the tip 15 of the practice cartridge 1 may engage and then slide over the rivet enabling the tip 15 to be positioned within the bore 236.

As described above, the shaft 47, the piston 51, the third portion 59 and the insert 61 are operatively coupled to the first portion 23. Additionally, the shaft 47, the piston 51, the third portion 59 and the insert 61 are movable relative to the first portion 23 during an impact of the breech bolt. Specifically, in practice, the spring assembly 53 absorbs a portion of a force from the breech bolt during dry firing and, thus, the practice barrel 21 is not damaged by the impact of the breech bolt that otherwise, over time, would make the practice barrel 21 inoperable. The anchoring section 29 is coupled to the grenade launcher during training exercises.

In contrast to the live cartridges, the practice cartridges 1 have a geometry that corresponds to the bore 236 of the practice barrel 21 that enables the practice cartridges 1 to be properly positioned within the practice barrel 21 to activate the firing pin (not shown) of the grenade launcher.

As discussed above, the practice barrel 21 includes the spring assembly 53 having a plurality of disc springs that surround the shaft 47 positioned between the first washer 212 and the piston 51. A length of the spring assembly 53 may be any suitable length and the disc springs of the spring assembly 53 may be replaced, added to, or removed to ensure that a desired spring force is achieved.

As described above, the practice barrel 21 includes the aperture 220 into which the stop pin 45 is positioned that engages the surface 228 to limit the forward movement of the shaft 47, the piston 51 and the third portion 59. Additionally, the interaction between the step 33 and the flange 55 limits the forward movement of the shaft 47, the piston 51 and the third portion 59 to ensure that the live cartridge can not be ignited and/or fully introduced into the practice barrel 21.

As discussed above, the second portion 25 of the practice barrel 21 may include an identifiable characteristic to differentiate the practice barrel 21 from the live round-handling barrel. In some examples, the identifiable characteristic may be, for example, paint, an electrochemically applied coating that covers the entire practice barrel 21 or portions of the practice barrel 21 such as, for example, annular rings about the second portion 25.

The practice cartridges 1 may be utilized at a firing range to, for example, interrupt the rate of fire. In some training exercises, every fourth live cartridge may be replaced with the practice cartridge 1 to control the rate of fire to three shot bursts. Additionally, once the practice cartridge 1 is positioned within the grenade launcher, the practice cartridge is removed from the cartridge chamber (not shown) as described above, and the grenade launcher is cocked to begin firing again. Additionally, limiting the shots fired to three shot bursts enables overseers to determine which recruits exhibit proficiency with the firearm.

In other examples, a blank cartridge (not shown) (e.g., a relatively weak blank cartridge) may be utilized with the practice barrel 21 whose shape and/or size is similar to the practice cartridge 1. The blank cartridge may be made of a plastic material having a predetermined breaking point near a tip (not shown) and a metal portion (not shown) near the bottom (not shown). In these examples, the practice barrel 21 may include a movable rear part (not shown) having an ejector (e.g., a nozzle). However, in other examples, the ejector may be omitted. The blank cartridge has an ignition delay so that the breech block is braked by a stop before the breech block recoils again. Thus, the relatively weak blank cartridge can operate the breech block and, the blank cartridge can be ejected from the grenade launcher and another blank cartridge may be introduced into the practice cartridge chamber 57. However, the cadence of the grenade launcher may be reduced when using such blank cartridges. While, in this example, the blank cartridge may be introduced to the practice barrel 21, the live cartridge, etc. still may not be utilized with the practice barrel 21.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A practice device for use with self-loading grenade launchers, comprising:

a practice barrel having a practice cartridge chamber to receive a practice cartridge, wherein a live cartridge does not correspond to the practice cartridge chamber and wherein the live cartridge is unable to be properly positioned within the practice barrel to prevent ignition of the live cartridge;

wherein the practice cartridge chamber is cushioned to substantially absorb a breech energy to substantially prevent damage to the practice barrel.

2. The practice device as defined in claim 1, wherein the practice cartridge has a first side that has dimensions that are substantially similar to dimensions of the live cartridge and wherein the practice cartridge has a second side that has dimensions that are different from the dimensions of the live cartridge.

3. The practice device as defined in claim 1, wherein a distance between about 20 millimeters from a tip of the practice cartridge toward a rear of the practice cartridge has a smaller diameter than a diameter of the live cartridge.

4. The practice device as defined in claim 1, wherein the practice cartridge has a slot relative to a longitudinal axis and wherein the slot is associated with a projection of a belt link.

5. The practice device as defined in claim 4, wherein the belt link moves toward a rear of the practice cartridge when the practice cartridge is positioned adjacent the practice cartridge chamber.

6. The practice device as defined in claim 1, wherein the practice cartridge includes a bore adjacent an opening toward a rear of the practice cartridge.

7. The practice device as defined in claim 1, wherein a weight of the practice cartridge is associated with a weight of the live cartridge.

8. The practice device as defined in claim 1, further comprising an insert having a first bore that is removably coupled within a second bore of the practice barrel, wherein the insert includes a first portion to be engaged by a second portion of the live cartridge to limit the movement of the live cartridge within the practice cartridge chamber to prevent ignition of the live cartridge.

9. The practice device as defined in claim 8, wherein a diameter of the first bore corresponds to a diameter of a portion of the practice cartridge.

10. The practice device as defined in claim 1, further comprising a shaft coupled to a piston having a third portion, wherein the shaft, the piston and the third portion are movably coupled relative to the practice barrel.

11. The practice device as defined in claim 10, furthering comprising a spring assembly positioned within a bore of the practice barrel between the piston and an end of the shaft.

12. The practice device as defined in claim 10, further comprising an aperture into which a stop pin is positioned and received by a block that is coupled to the practice barrel, wherein the stop pin is to engage a surface of the aperture to limit the movement of the shaft relative to the practice barrel.

13. The practice device as defined in claim 10, further comprising a step within a bore of the practice barrel to be engaged by a flange of the piston to limit the movement of the piston relative to the practice barrel.

14. The practice device as defined in claim 1, wherein the practice barrel comprises a characteristic to differentiate the practice barrel from a live round-handling barrel.

15. A practice barrel for use with firearms, comprising:

a first portion having a first bore;

a shaft at least partially positioned within the first bore;

a block having an aperture to receive the shaft, wherein the block is positioned and coupled within the first bore;

a piston coupled to the shaft on a first side and coupled to an elongated member having a practice cartridge chamber on a second side, wherein the elongated member extends from the first portion;

a spring assembly positioned within the first bore between the block and the piston, wherein the spring assembly exerts a force on at least one of the block and the piston; and an insert having a second bore to receive at least portion of a practice cartridge, wherein the insert includes a first portion to be engaged by a second portion of a live cartridge to limit the movement of the live cartridge within the practice cartridge chamber to prevent ignition of the live cartridge;

wherein at least the shaft, the piston, the elongated member and the spring assembly are movable relative to the practice barrel to at least partially absorb an impact from a breech block.

16. The practice barrel as defined in claim 15, wherein the elongated portion includes a first step to engage a second step of the first portion to limit the movement of the elongated portion relative to the first portion.

17. The practice barrel as defined in claim 15, wherein the first bore includes a step to be engaged by a flange of the piston to limit the movement of the piston relative to the first portion.

18. The practice barrel as defined in claim 15, wherein the first portion defines an aperture into which a stop pin is positioned and received by the block and wherein the stop pin is to engage a surface of the aperture to limit the movement of the shaft relative to the first portion.

* * * * *